US006157143A

United States Patent [19]

Bigio et al.

[11] Patent Number: 6,157,143

[45] Date of Patent: Dec. 5, 2000

[54] FLUROESCENT LAMPS AT FULL FRONT SURFACE LUMINANCE FOR BACKLIGHTING FLAT PANEL DISPLAYS

[75] Inventors: Laurence Bigio, University Heights, Ohio; Ljubisa Dragoljub Stevanovic, Niskayuna, N.Y.

[73] Assignee: General Electric Company, Schenectady, N.Y.

[21] Appl. No.: 09/261,073

[22] Filed: Mar. 2, 1999

[51] Int. Cl.[7] ..... G05F 1/00

[52] U.S. Cl. ..... 315/307; 315/309; 315/291; 315/224

[58] Field of Search ..... 315/224, 112, 315/117, 118, 291, 293, 302, 307, 309, 308

[56] References Cited

U.S. PATENT DOCUMENTS

| | | | |
|---|---|---|---|
| 4,659,183 | 4/1987 | Suzuwa | 350/345 |
| 5,019,749 | 5/1991 | Ito | 315/224 |
| 5,408,162 | 4/1995 | Williams | 315/224 |
| 5,786,801 | 7/1998 | Ichise | 345/102 |
| 5,834,908 | 11/1998 | Boland et al. | 315/307 |
| 5,854,617 | 12/1998 | Lee et al. | 345/102 |
| 5,886,759 | 3/1999 | Mashino et al. | 349/65 |
| 5,896,119 | 4/1999 | Evanicky et al. | 345/87 |
| 5,907,222 | 4/1999 | Lengyel et al. | 315/158 |

*Primary Examiner*—David Vu
*Assistant Examiner*—Tuyet T. Vo
*Attorney, Agent, or Firm*—Jill M. Breedlove; Douglas E. Stoner

[57] ABSTRACT

A back-light assembly for a liquid crystal display (LCD) includes an LCD display screen and at least one cold cathode fluorescent lamp positioned for illuminating a back-side of the display screen. A reflector positioned adjacent the lamp reflects light toward the display screen. A light diffuser is positioned between the lamp and the display screen; and a power controller regulates current supplied to the lamp from an external power source so as to establish a predetermined luminance level at the display screen. A light level sensor provides a signal representative of the luminance output of the lamp to the controller so as to regulate lamp current to maintain the predetermined luminance level.

20 Claims, 2 Drawing Sheets

FLUROESCENT LAMPS AT FULL FRONT SURFACE LUMINANCE FOR BACKLIGHTING FLAT PANEL DISPLAYS

BACKGROUND OF THE INVENTION

The present invention relates to cold cathode fluorescent lamps, and more specifically, to a method and apparatus for extending the life of cold cathode fluorescent lamps operating at full front surface luminance when used for backlighting flat panel displays.

Either hot cathode or cold cathode fluorescent lamp systems are used to illuminate liquid crystal flat panel displays. The choice between hot or cold cathode fluorescent lamps is selected based on the brightness, efficiency, and dimming desired. Hot cathode fluorescent lamps' typical life span is approximately 20,000 hours, with end-of-life being sudden. The sudden end-of-life is caused by the unavoidable loss of barium in the emission mix material that covers the electrodes. To assure thermionic emission of electrons in dimming applications, additional power is generally needed to maintain optimum electrode hot-spot temperature. Even in applications with optimized filament heating, the predominant lamp failure mechanism is filament failure. The hot cathode life cannot be significantly extended even if operation is at a much lower current. Cold cathode fluorescent lamps do not have these deficiencies.

Unlike hot cathode lamps, cold cathode lamps have large metal electrodes that do not require additional heating. Both hot and cold cathode lamps experience a slow degradation of phosphor conversion efficiency. Unique to cold cathode lamps is a gradual darkening of the lamps' ends which eventually spreads to the whole tube. This darkening is due to ion bombardment of the electrodes and subsequent sputtering of electrode metal material to the wall. The life of cold cathode lamps is measured as a half-brightness life when operating at full-on constant power. The typical half-life for cold cathode lamps is 20,000 hours.

A known solution to lamp luminance degradation is allowing the user dimming capability. Dimming is typically accomplished through either current limiting or pulse width modulation (PWM). In the current limiting mode, the lamp current is reduced, but the lamp stays on all the time. In the PWM mode, the lamp is turned full on and off at a repetition rate of about 100 to 400 Hz with a dimming range being determined by the duty cycle (fraction on time). A problem with the prior art is that the user controls the brightness, enabling full-on initial brightness. Full brightness may be more than required in the system design. Operating at full power will result in an accelerated luminance depreciation due to phosphor degradation. If the design utilizes hot cathode lamps, no extension of lamp life could be expected if lamp dimming is used.

As an illustration, consider a backlight application in a flat panel display where the display surface luminance requirement is 100 footlamberts (fl). If the designer chooses either a hot cathode or cold cathode lamp with a resulting maximum front surface luminance value of 100 fl, the luminance will gradually drop over time, and the front surface luminance will have less than the desired 100 fl. In this application, the cold cathode loss rate will typically be higher than the hot cathode loss rate, but the hot cathode failure would be sudden. The cold cathode lamps would simply get dimmer. If the designer chooses higher rated brightness lamps but does not scale the current down, the initial full-on brightness would be greater than desired, but would decay over time eventually reaching the desired 100 fl and then decay beyond this point due to phosphor degradation during the normal life of the lamp. In other words, no extended life of the lamp is realized. Accordingly, it would be advantageous to provide a method and system to significantly extend the life of cold cathode lamps.

BRIEF SUMMARY OF THE INVENTION

In one embodiment of the present invention, flat panel display backlight life is improved by utilizing a higher rated luminance cold cathode lamp coupled with an active current control mechanism to deliver desired brightness. The current control mechanism is used to vary the current from a minimum brightness up to, but not exceeding, the designed full-on brightness of the flat panel display. This current control method extends the life of a cold cathode lamp, two to three times the manufactured projected life by operating at reduced power for a significant part of the cold cathode lamp's extended life. By starting with a cold cathode lamp rated at a higher luminance than desired, the initial power can be initially scaled back. Over time, the power is then raised to maintain the desired flat panel display luminance.

BRIEF DESCRIPTION OF THE DRAWINGS

For a better understanding of the present invention, reference the following detailed description taken in conjunction with the accompanying drawings in which.

DETAILED DESCRIPTION OF THE INVENTION

Figure 1:
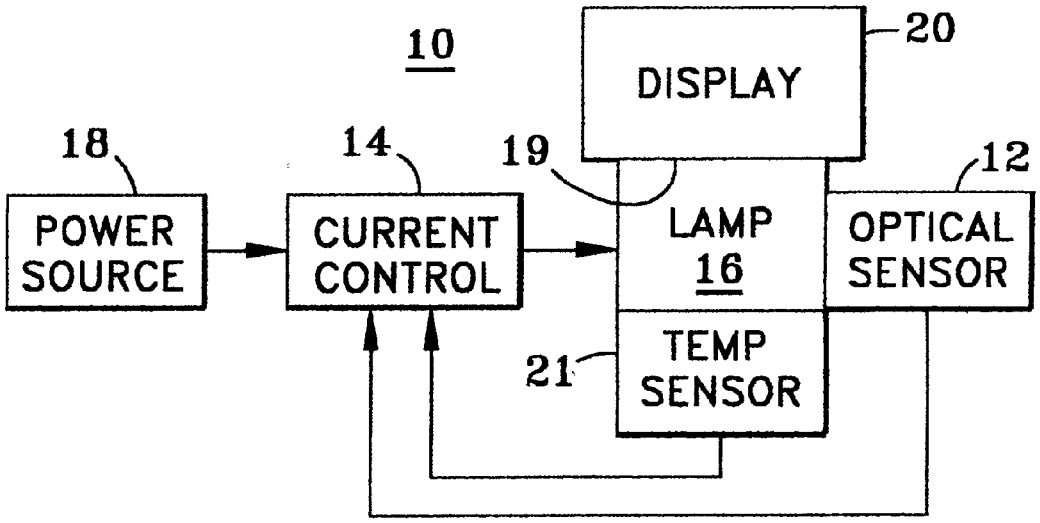
FIG. 1 is a simplified, block diagram representation of one embodiment of a lamp operating system according to the present invention with an optical sensor.

FIG. 1 is a simplified, block representation of one embodiment of a fluorescent lamp operating system 10 incorporating at least some of the teachings of the present invention as applied to a selected application such as the backlighting of an LCD flat panel display. The embodiment of FIG. 1 includes an optical sensor 12 connected to a current control mechanism 14. The current control mechanism 14, which incorporates current limiting techniques commonly used in the prior art, is designed to control and maintain a desired luminance value of a cold cathode fluorescent lamp 16. A power source 18 is coupled to the system, energizing the lamp 16, and the optical sensor 12 automatically signals the current control 14 to adjust the current to meet the desired luminance of lamp 16. The current control 14 is preset with a specified luminance value needed to achieve a specified flat panel display luminance when the lamp 16 is positioned adjacent a back or non-viewing surface 19 of a flat panel display 20 such as a liquid crystal display (LCD). The current control 14 will adjust the current to lamp 16 until the luminance value detected by the optical sensor 12 corresponds to the desired luminance at the face of a flat panel display 20. Though not the only location possible, the optical sensor 12 could be mounted behind the fluorescent lamp 16, i.e., opposite the display 20. In such case, an initial calibration is required to correlate sensor signal to front surface luminance of the display. The current control 14 is further designed to prevent excessive lamp currents that could shorten lamp life. The optical sensor 12 could be further modified to collect and use lamp temperature information obtained by a conventional temperature sensor 21 which provides a signal input to current control 14 to adjust the maximum lamp current accordingly and avoid overdriving the lamp after a cold start or when the ambient temperature is very low.

Various implementations of the current control 14 will be apparent to those of ordinary skill in the art. For example, the control 14 may utilize a conventional pulse width modulation (PWM) circuit in which the duty cycle (per cent on-time) is varied inversely with the amount of light sensed by photodetector or optical sensor 12 so as to adjust the lamp output to a desired value. It may also be desirable to employ a control interface with the PWM implementation in which the control interface includes programmable logic for changing the desired value of lamp luminescence. Use of programmable logic whether implemented in a specially designed integrated circuit or in a general purpose microcomputer also allows for a simplified circuit such as that shown in FIG. 2 in which the optical sensor 12 is eliminated. The circuit of FIG. 2 may be a lower cost option and is simply programmed to adjust lamp luminescence as a function of lamp age. The current control 22 may also respond to lamp temperature sensor 21 to protect the lamp in cold temperature.

Figure 2:
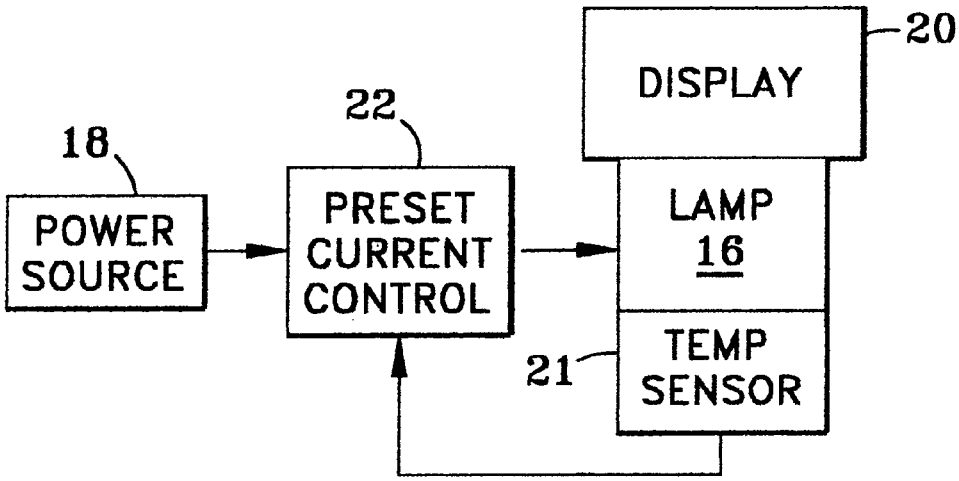
FIG. 2 is a simplified block diagram of another embodiment of a lamp operating system according to the present invention.

The system of FIG. 2 includes a preset or programmable current control mechanism 22 which replaces the combination optical sensor 12 and current control mechanism 14. As with the optical sensor system 10 of FIG. 1, the preset or programmable current control 22 is set to initially provide current to the fluorescent lamp 16 at a reduced level and then increase the current based on a predetermined formula such as the power profile represented in FIG. 3 where the current increase is based on the total burn time (age) of the lamp. By adjusting power to the lamp 16 so as to follow a preset current control curve, the lamp will not receive excessive lamp currents capable of shortening the lamp's life until long after the manufacturer's projected life of the lamp.

As an illustration, suppose that a cold cathode lamp illuminates at 3800 fl when operating at full design power of 27 Watts (W). The manufacturer calculates the half-brightness life at 12,000 hours. Only 1500 fl are needed to yield a luminance of 100 fl from the front of a flat panel display. (100 fl is a typical level desired for high brightness applications such as daylight readable.) The initial current would be scaled back so that the initial power is approximately 40% of the full possible power. Since the cold cathode lamp's life is roughly 1/(power1.8), the current (and thus power) would be slowly raised over time in a manner illustrated in FIG. 3.

Figure 3:
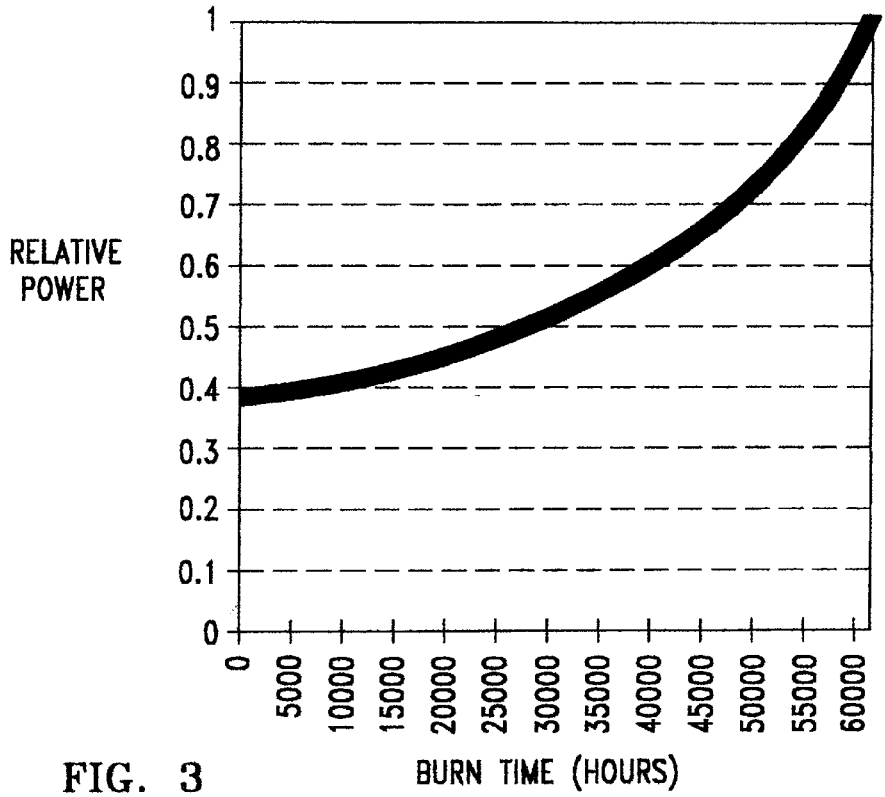
FIG. 3 is an exemplary graphical representation of relative power versus burn time for maintaining a constant luminance value.

FIG. 3 represents the relative power needed to maintain 100 fl at the front of a flat panel display. To maintain 100 fl from the front of a flat panel display, the power to the backlight only reaches its full design value of 27 W after approximately 61,000 hours of operation. Once at 27 W, the current would be kept fixed at its full nominal design current, leaving the lamp to operate at 27 W until natural decay starts. Additional data about lamp life versus current could result in a slightly modified programmed current control curve.

Figure 4:
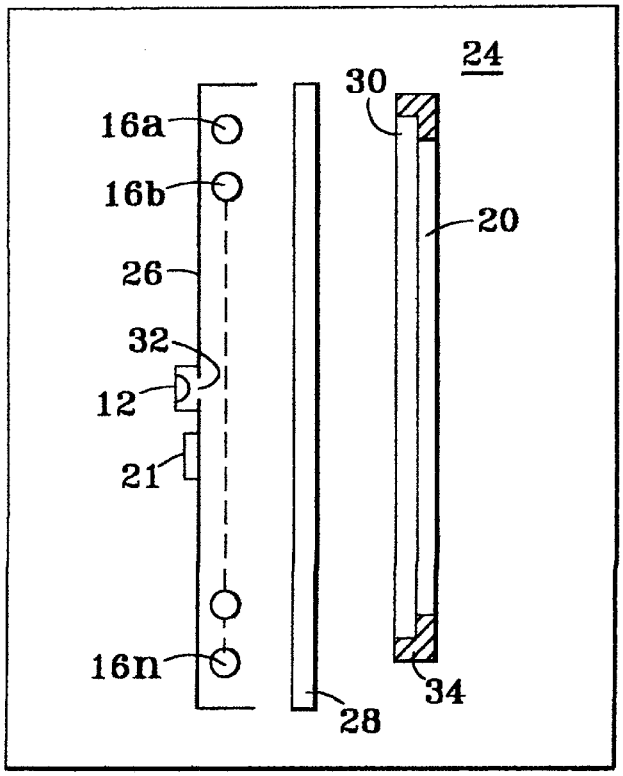
FIG. 4 is an illustration representing exemplary physical placement of components with a flat panel display.

FIG. 4 represents a cross section of a possible flat panel display system 24 with which the inventive lamp luminescence control system may be used. A plurality of cold cathode lamps 16*a*–16*n* are placed at a pre-selected distance in front of an aluminum or other type reflector 26 and at a pre-selected distance behind a secondary diffuser 28. A primary diffuser 30 is placed adjacent a rear surface of a liquid crystal display (LCD) 20 and held in place by frame 34. The optical sensor 12 is placed in a position to obtain a representative gage of the luminance level of lamps 16, such as being mounted onto reflector 26 on a surface opposite the surface adjacent the lamps 16 but with a view port 32 through which the optical sensor can detect light levels. Similarly, temperature sensor 21 may be mounted to the reflector 26 so as to detect ambient operating temperature.

While the invention has been described in what is presently considered to be a preferred embodiment, many variations and modifications will become apparent to those skilled in the art. Accordingly, the invention should not be limited to the specific illustrative embodiment but be interpreted within the full spirit and scope of the appended claims.

What is claimed is:

1. A method of extending the useful life of a cold cathode fluorescent lamp of the type in which the luminance output drops during the operating life of the lamp, the method comprising the steps of:

establishing a desired level of luminance in a selected application;

installing in the application a cold cathode fluorescent lamp having a luminance rating higher than the desired level; and controlling power applied to the lamp to operate initially at a reduced power level which is increased over the operating life of the lamp in a manner to maintain substantially constant luminance at the desired level over the useful life of the lamp.

2. The method of claim 1 wherein the step of controlling power comprises the step of regulating current to the lamp.

3. The method of claim 2 wherein the step of regulating current comprises regulating current in accordance with a predetermined relationship of lamp current as a function of lamp life for maintaining substantially constant luminance at the desired level.

4. The method of claim 2 further comprising the steps of monitoring luminance output of the lamp and adjusting current to maintain a constant value of luminance output.

5. The method of claim 2 wherein the step of regulating includes pulse width modulating power to the lamp to regulate current.

6. A back-light assembly for a liquid crystal display (LCD) comprising:

an LCD display screen;

at least one cold cathode fluorescent lamp positioned for illuminating a back-side of said display screen, said at least one lamp having a luminance rating higher than the desired level of luminance for the back-light assembly;

a reflector positioned and arranged adjacent to said at least one lamp for reflecting luminance from said lamp toward said display screen;

at least one light positioned between said lamp and said display screen; and a power controller for controlling power applied to said at least one lamp to operate initially at a reduced power level which is increased over the operating life of the lamp in a manner to maintain substantially constant luminance at the desired level over the useful life of the lamp.

7. The back light assembly of claim 6, further comprising a luminance level sensor for providing a sensor signal representative of the luminance output of said at least one lamp, said controller being responsive to said sensor signal for regulating lamp current to maintain said predetermined luminance level.

8. The back light assembly of claim 7, further comprising a temperature sensor positioned adjacent to said lamp for providing a signal representative of lamp operating temperature said power controller being responsive to said temperature sensor signal for reducing lamp current at initial start-up and in cold ambient temperature.

9. The back light assembly of claim 6 wherein said power controller comprises a programmable controller programmed to vary current to said lamp in proportion to the number of lamp operating hours.

10. The back light assembly of claim 9 a temperature sensor positioned adjacent to said lamp for providing a signal representative of lamp operating temperature said power controller being responsive to said temperature sensor signal for reducing lamp current at initial start-up and in cold ambient temperatures.

11. A method of extending the useful life of a cold cathode fluorescent lamp of the type in which the luminance output drops during the operating life of the lamp, the method comprising the steps of:

establishing a desired level of luminance in a selected application;

installing in the application a cold cathode fluorescent lamp having a luminance rating higher than the desired level;

sensing the output luminance of the lamp; and controlling current provided to said at least one lamp based on the sensed output luminance by initially providing current at a reduced level which is increased over the operating life of the lamp in a pre-determined manner to maintain substantially constant luminance at the desired level over the useful life of the lamp.

12. The method of claim 11, further comprising the step of sensing lamp operating temperature, the step of controlling current further comprising reducing lamp current at initial start-up and in cold ambient conditions.

13. A method of extending the useful life of a cold cathode fluorescent lamp of the type in which the luminance output drops during the operating life of the lamp, the method comprising the steps of:

establishing a desired level of luminance in a selected application;

installing in the application a cold cathode fluorescent lamp having a luminance rating higher than the desired level;

providing lamp current versus lamp life data for the lamp;

controlling current provided to said at least one lamp based on the current versus lamp life data by initially providing current at a reduced level which is increased over the operating life of the lamp according to the data to maintain substantially constant luminance at the desired level over the useful life of the lamp.

14. The method of claim 13, further comprising the step of sensing lamp operating temperature, the step of controlling current further comprising reducing lamp current at initial start-up and in cold ambient conditions.

15. A back-light assembly for a liquid crystal display (LCD) comprising:

an LCD display screen;

at least one cold cathode fluorescent lamp positioned for illuminating a back-side of said display screen, said at least one lamp having a luminance rating higher than the desired level of luminance for the back-light assembly;

a reflector positioned and arranged adjacent to said at least one lamp for reflecting luminance from said lamp toward said display screen;

at least one light positioned between said lamp and said display screen;

a sensor for detecting output luminance of said at least one lamp; and a current controller for regulating current supplied to said lamp from an external power source based on the sensed output luminance in order to operate initially at a reduced power level which is increased over the operating life of the lamp in a manner to maintain substantially constant luminance at the desired level over the useful life of the lamp.

16. The back-light assembly of claim 15 wherein said current controller comprises a PWM controller for varying duty cycle of the current inversely with the detected output luminance.

17. The back-light assembly of claim 15, further comprising a temperature sensor for sensing lamp operating temperature, the current controller reducing lamp current based on the sensed lamp operating temperature at initial start-up and in cold ambient conditions.

18. A back-light assembly for a liquid crystal display (LCD) comprising:

an LCD display screen;

at least one cold cathode fluorescent lamp positioned for illuminating a back-side of said display screen, said at least one lamp having a luminance rating higher than the desired level of luminance for the back-light assembly;

a reflector positioned and arranged adjacent to said at least one lamp for reflecting luminance from said lamp toward said display screen;

at least one light positioned between said lamp and said display screen; and a programmable current controller for regulating current supplied to said lamp from an external power source based on predetermined lamp current versus lamp life data in order to operate initially at a reduced power level which is increased over the operating life of the lamp in a manner to maintain substantially constant luminance at the desired level over the useful life of the lamp.

19. The back-light assembly of claim 18, further comprising a temperature sensor for sensing lamp operating temperature, the current controller reducing lamp current based on the sensed lamp operating temperature at initial start-up and in cold ambient conditions.

20. The back-light assembly of claim 18 wherein said current controller comprises a PWM controller.

* * * * *

UNITED STATES PATENT AND TRADEMARK OFFICE

CERTIFICATE OF CORRECTION

PATENT NO. : 6,157,143
DATED : December 5, 2000
INVENTOR(S) : Laurence Bigio; Ljubsia Dragolijub Stevanovic It is certified that error appears in the above-identified patent and that said Letters Patent is hereby corrected as shown below:

Title page.
Item [54], title should read: FLOURESCENT LAMPS AT FULL FRONT SURFACE LUMINANCE FOR BACKLIGHTING FLAT PANEL DISPLAYS Signed and Sealed this Second Day of October, 2001

*Attest:*

Nicholas P. Godici

NICHOLAS P. GODICI
*Acting Director of the United States Patent and Trademark Office*

*Attesting Officer*